US006401931B1

(12) United States Patent
Javell et al.

(10) Patent No.: US 6,401,931 B1
(45) **Date of Patent: *Jun. 11, 2002**

(54) COLLAR STAY STORAGE DEVICE

(76) Inventors: Louis L. Javell, 950 W. Barry, Chicago, IL (US) 60657; Michael Ferrandino, 6140 W. Cornelia, Chicago, IL (US) 60634

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/241,356

(22) Filed: Feb. 2, 1999

(51) Int. Cl.[7] ..... B65D 25/54

(52) U.S. Cl. ..... 206/775; 206/814; 206/248; 206/443; 206/214

(58) Field of Search ..... 206/775, 779, 206/780, 782, 566, 6.1, 443, 366, 248, 814, 804, 214; 211/69, 69.1

(56) References Cited

U.S. PATENT DOCUMENTS

| | | | | | |
|---|---|---|---|---|---|
| 1,409,665 | A | * | 3/1922 | Butler | 206/248 |
| 2,637,299 | A | * | 5/1953 | Salkey | 206/214 |
| 3,273,701 | A | * | 9/1966 | Friedman | 206/214 |
| 4,415,092 | A | * | 11/1983 | Boyer | 211/69.1 |
| 4,597,122 | A | * | 7/1986 | Handler et al. | 217/62 |
| 4,993,545 | A | * | 2/1991 | Feiler | 206/566 |
| D349,011 | S | | 7/1994 | Cohen et al. | |
| 5,396,989 | A | * | 3/1995 | Hein | 206/366 |
| D360,810 | S | | 8/1995 | Humaj | |
| 5,494,181 | A | * | 2/1996 | Denney | 217/62 |
| 5,823,363 | A | * | 10/1998 | Cassel | 206/366 |
| 5,850,917 | A | * | 12/1998 | Denton et al. | 206/366 |

* cited by examiner

*Primary Examiner*—Mickey Yu
*Assistant Examiner*—Jila M. Mohandesi
(74) *Attorney, Agent, or Firm*—Lee, Mann, Smith, McWilliams, Sweeney & Ohlson

(57) ABSTRACT

A collar stay storage device is provided in the form of a block having a slanted top portion with a plurality of slots extending into the block from the slanted top portion. Shims within the slots provide storage of different sized collar stays.

9 Claims, 2 Drawing Sheets

COLLAR STAY STORAGE DEVICE

BACKGROUND OF THE INVENTION

A. Field of the Invention

This invention relates to storage devices and more specifically to a collar stay storage device having a slanted top surface with a plurality of slots for storing collar stays.

B. Prior Art

Collar stays are generally plastic and sometimes metal devices that may be inserted into a slot underneath the collar of a shirt or blouse. The collar stay provides additional stiffness to a collar, thus keeping the collar down and in place without the necessity of buttons. Therefore, a collar stay keeps the tip of a collar from curving upward.

Collar stays are manufactured in varying sizes to fit different sized shirt collars. One problem encountered when using collar stays that are plastic is that they are easily breakable. Another problem encountered by users of collar stays is that they may become easily misplaced when not in use because of their small size. For example, if the collar stay is left in place when the shirt or blouse is not worn, it may become dislodged, lost or broken when the garment is washed or sent to the cleaners.

Accordingly, it is known in the art to provide a vertically oriented clear plastic box for holding collar stays of the same size. Such a box is not aesthetically pleasing, and cannot properly hold collar stays of differing lengths. Additionally, because the top surface of such a box is flat, the stays are not easily insertable or removable.

SUMMARY OF THE INVENTION

A collar stay storage device is provided having a slanted top portion with a plurality of slots. Shims within the slots are provided to allow storage of different sized collar stays.

Accordingly, it is a primary object of the present invention to provide a collar stay storage device with slots for easily inserting and removing collar stays.

It is another object of the present invention to provide a collar stay storage device with slots for storing collar stays of different sizes.

These and other objects of the invention will become apparent from the specification, the drawings and the foregoing description of the preferred embodiments.

DESCRIPTION OF THE PREFERRED EMBODIMENTS

Figure 1:
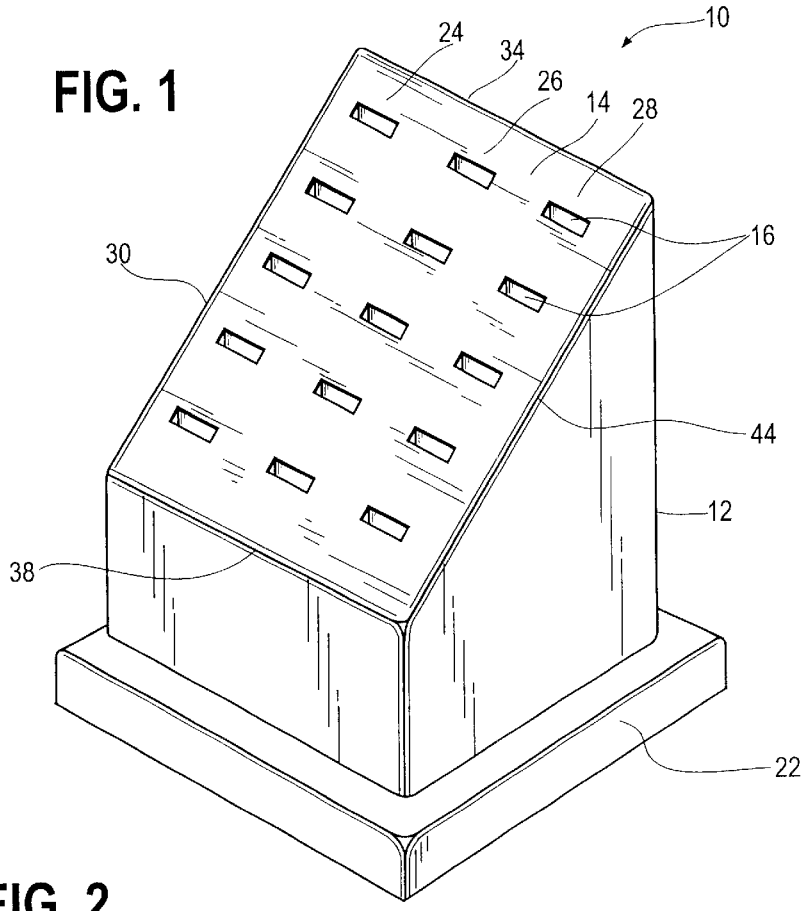
FIG. 1 is a front perspective view of the collar stay holder of the present invention.
Figure 4:
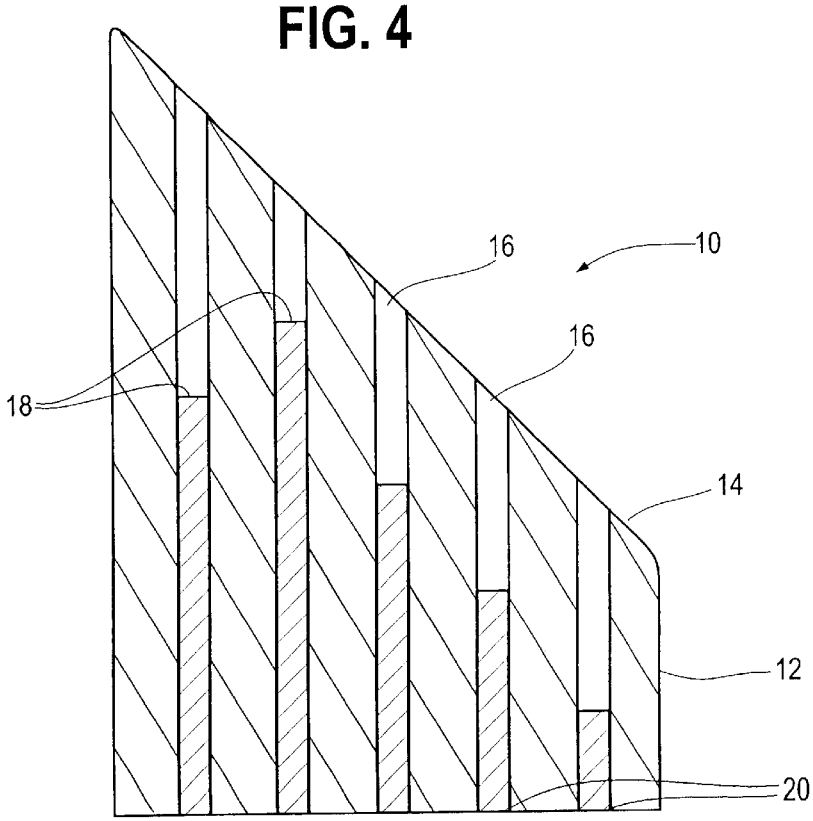
FIG. 4 is a cross sectional side view of FIG. 2 along the line 4—4.

As shown in FIG. 1, the collar stay storage device 10 of the present invention has a substantially block-shaped body 12 having a slanted top surface 14 with a plurality of slots 16 disposed thereupon. The slots 16 extend downward into the block body 12 for a preselected distance from the slanted top 14. As shown in FIG. 4, the plurality of slots 16 include a shim 18 placed at the bottom end 20 of each slot 16. The block-shaped body 12 is preferably made of wood such as cedar but any appropriate material like wood, plastic or metal may be employed.

As shown in FIG. 1, a cedar base 22 may be attached on the bottom surface (not shown) of block-shaped body 12. The base 22 may be made of any appropriate material like wood, metal, or stone. Examples of such materials include oak, brass and marble. It is preferred that the block-shaped body 12 be generally cube-shaped except for the slanted top surface 14. It is apparent, however, to those skilled in the art that any other appropriate shape like a rectangular block may be employed.

Figure 2:
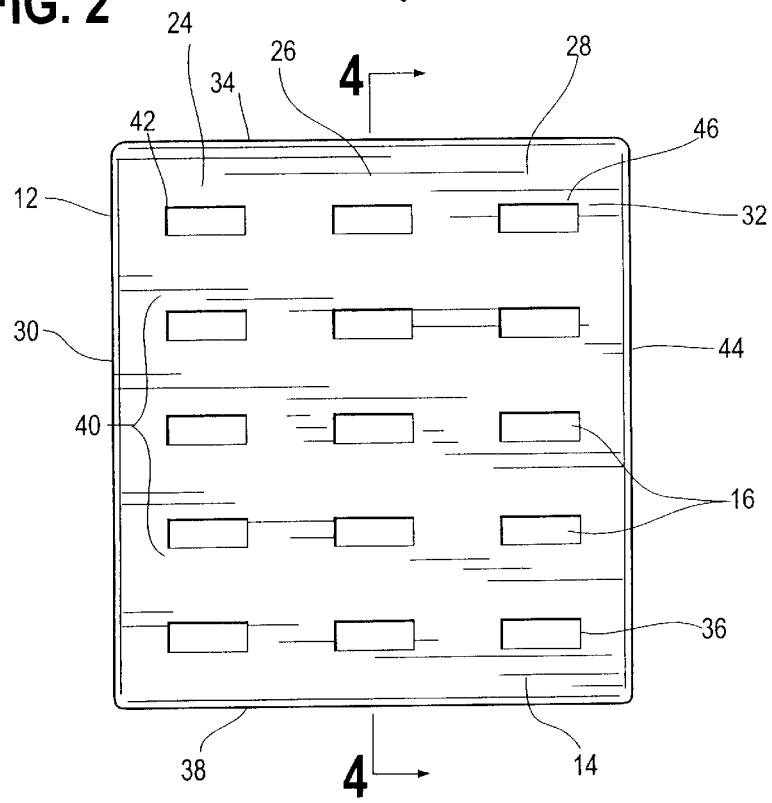
FIG. 2 is a top plan view of the present invention as depicted in FIG. 1.
Figure 3:
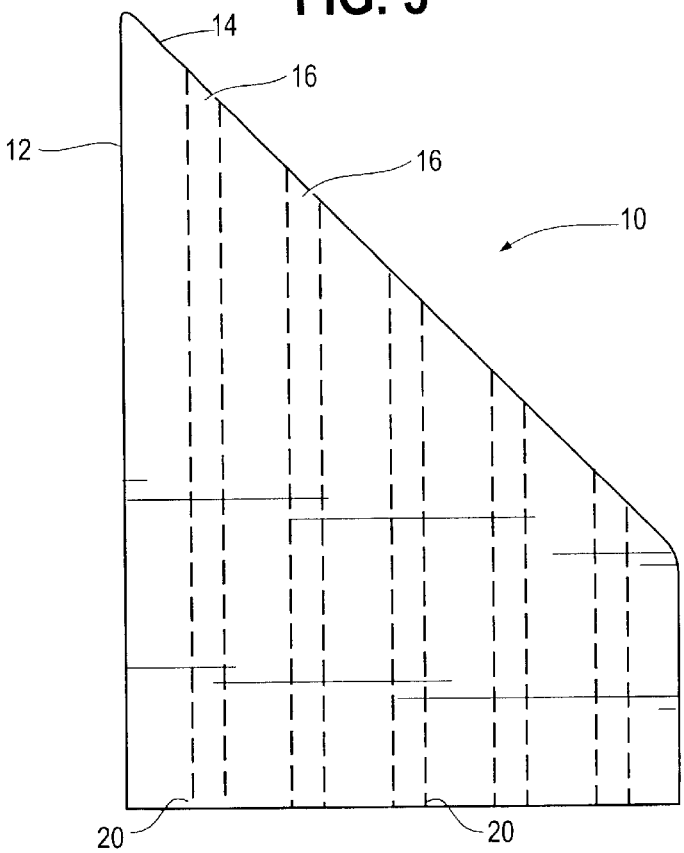
FIG. 3 is a side plan view of the present invention as depicted in FIG. 1.

As shown in FIGS. 1 & 2, in the illustrated embodiment, the plurality of slots 16 consists of three columns of slots 24, 26, 28. As shown in FIG. 2, the first column of slots 24 is positioned approximately one-half inch (½") from the left edge 30 of the slanted top surface 14. Each slot 16 is approximately three-eighths of an inch (⅜") wide by one-eighth inch (⅛") tall. As shown in FIGS. 3 and 4, the depth of each slot 16 may vary depending on the size of the stay desired to be stored. The depth of each slot 16 is determined by the placement of the shim 18 at the bottom 20 of each slot 16. Preferably, the shims 18 will be located in each slot 16 such that a collar stay placed in a particular slot will protrude approximately one-half inch above slanted surface 14 for ease of removal from the block body 12. It is understood while these dimensions are preferred for optimal fit of collar stays within the slots 16 of the collar stay storage device 10, any appropriate dimension may be employed for each slot 16. It is also understood that the size and dimensions of body 12 may vary, thereby varying the number of slots 16. Additionally, while three columns 24, 26, 28 are preferred, the number of columns on the pattern employed for the plurality of slots 16 may be varied.

As shown in FIG. 2, the top row 32 of slots 16 is approximately seven-sixteenths of an inch (7⁄16") from the upper edge 34 of the slanted top surface 14, while the bottom row 36 of slots 16 is also approximately seven-sixteenths of an inch (7⁄16") above the lower edge 38 of the slanted top surface 14. Rows 40 of slots 16 between the top row 32 and bottom row 36 are spaced approximately five-eighths of an inch (⅝") from each other. The left edge 42 of the first column 24 and the right edge 46 of the third column are approximately one-half inch (½") from the left edge 30 and right edge 44 respectively of slanted top surface 14. Approximately seven-sixteenths of an inch (7⁄16") separate each column 24, 26, 28.

In operation, a user inserts each collar stay in an appropriate slot 16. Each collar stay rests on a shim 18 and protrudes upward approximately one-half inch (½") above the slanted top surface 14 of the storage device 10. Because of the distance between columns 24, 26, 28 and the height at which the collar stay protrudes, each collar stay in the collar stay storage device 10 is easily insertable and removable.

The foregoing description of the embodiments of the invention has been presented for purposes of illustration and description, and is not intended to be exhaustive or to limit the invention to the precise form disclosed. The description was selected to best explain the principles of the invention and practical application of these principles to enable others skilled in the art to best utilize the invention in various embodiments and modifications as are suited to the particular use contemplated. It is intended that the scope of the invention not be limited by the specification, but be defined by the claims set forth below.

We claim:

1. A collar stay storage device, comprising:

a body having an angled top, a bottom, a front, a back and opposite sides; and a plurality of slots extending into said body from said top; each said slot being open at said top and extending generally downward a predetermined distance to a closed slot bottom surface; each said slot having a width adapted to selectively receive at least one collar stay in a free fit; each said slot bottom surface is defined by a horizontal supportive shim surface on a shim extending generally downward from the horizontal supportive shim surface to support the collar stay on the bottom of the collar stay, with a portion of said collar stay extending partially above the angled top of the body.

2. The collar stay storage device as described in claim 1 wherein the body is substantially cube-shaped except for the slanted top.

3. The collar stay storage device as described in claim 1 where in said slots are of varying depths.

4. The collar stay storage device as described in claim 1 wherein the body of the collar stay storage device is made of wood.

5. The collar stay storage device as, described in claim 1 further comprising a base attached to the bottom of said body.

6. A collar stay storage device, comprising:

a block-shaped body having an angled top, a bottom, a front, a back and opposed sides; and a plurality of slots extending into said body from said top; each said slot being open at said top and extending generally downward to said bottom; each said slot having a horizontal supportive shim surface on a shim extending generally downward from the horizontal supportive shim surface disposed within the slot; each said slot having a width adapted to selectively receive at least one collar stay in a free fit, wherein said shim supports the collar stay on the bottom of the collar stay and within the body with a portion of said collar stay extending above the top.

7. A collar stay storage device as described in claim 6 wherein said slots are of varying depths.

8. A collar stay storage device as described in claim 6 further comprising a base attached to the bottom of said body.

9. A collar stay storage device, comprising:

a substantially cube-shaped wooden body having an angled top, a bottom, a front, a back and opposed sides, a plurality of slots extending into said body from said top; each said slot being open at said extending generally downward to a horizontal supportive shim surface on a shim extending generally downward from the horizontal supportive shim surface dispose within the slot; each said slot having a width adapted to selectively receive at least one collar stay in a free fit with said shim supporting the collar stay on the bottom and within the slot, and a cedar base attached to the bottom of said body.

* * * * *